US005981879A

United States Patent [19]

Blanding

[11] Patent Number: 5,981,879

[45] Date of Patent: Nov. 9, 1999

[54] INSULATING SUPPORT DEVICE FOR ELECTRICAL CONDUCTOR

[75] Inventor: Douglas Blanding, Bridgeport, N.Y.

[73] Assignee: New Line Products, LLC, Bridgeport, N.Y.

[21] Appl. No.: 08/953,456

[22] Filed: Oct. 17, 1997

[51] Int. Cl.[6] ..... H01B 17/16; H01B 17/14; H01B 17/02

[52] U.S. Cl. ..... 174/168; 174/179; 174/174; 174/172; 174/44

[58] Field of Search ..... 174/179, 145, 174/83, 44, 154, 158 R, 167, 168, 170, 174, 172

[56] References Cited

U.S. PATENT DOCUMENTS

| | | | |
|---|---|---|---|
| 960,827 | 6/1910 | Conway et al. | 174/163 R |
| 1,240,844 | 9/1917 | Gregur | 174/155 |
| 1,664,172 | 3/1928 | Holler | 174/165 |
| 3,483,314 | 12/1969 | Harmon | 174/140 R |
| 3,731,942 | 5/1973 | Buck | 279/4.06 |
| 3,833,971 | 9/1974 | Grasman et al. | 24/132 |
| 4,928,937 | 5/1990 | Berstein | 269/136 |
| 5,062,290 | 11/1991 | Hoover | 72/416 |
| 5,178,480 | 1/1993 | Chajima et al. | 403/15 |

*Primary Examiner*—Kristine Kincaid
*Assistant Examiner*—Mark Olds
*Attorney, Agent, or Firm*—George R. McGuire

[57] ABSTRACT

A device providing an insulating support for an electrical conductor includes a body having a through bore with an upper, cylindrical portion and a lower, threaded portion. A hook extends integrally from the upper end of the body over the upper end of the cylindrical bore. A piston in the cylindrical bore has an upper end for mating engagement with the hook to define a fully enclosed passageway surrounding the conductor upon movement of the piston from an initial position, wherein the conductor may be moved laterally to a position between the hook and the upper end of the piston, to a terminal position wherein the conductor is fully surrounded by surface portions of the hook and piston. A threaded insert is engaged in the threaded portion of the body axial bore. A passageway through the insert has a one-way valve for injection of silicone gel into the cylindrical portion of the body bore to move the piston from its initial to its terminal position. An internally threaded, blind bore in the insert is provided for mounting the device on a threaded shaft such as those conventionally positioned on utility poles.

20 Claims, 6 Drawing Sheets

INSULATING SUPPORT DEVICE FOR ELECTRICAL CONDUCTOR

BACKGROUND OF THE INVENTION

The present invention relates to insulating supports for mounting upon a pole, tower, or the like, for supporting an electrical conductor such as a transmission or distribution line. More specifically, the invention relates to an insulating support device having means actuable to provide improved connection of the device to the cable.

Electrical power lines are commonly supported at elevated positions on poles or towers with an appropriate insulating device mounted upon the pole and connected to the power line. Among the more widely used types of support structures are those known as candlestick and cross-arm types having a plurality of externally threaded shafts for engagement with internally threaded cavities in the insulating devices. The power line, normally a copper or aluminum cable, is attached to the insulating device by a conductor tie, i.e., a length of wire which is looped around the insulating device and around the cable according to prescribed standards. The prior art also includes insulating devices having threaded, vise-like clamps for affixing the device to the cable.

It is necessary, of course, that the cable be firmly, essentially permanently connected to the insulating device. It is also desirable that the operation of connecting the conductor to the insulating device be simple and speedy, commensurate with providing an effective connection in a safe manner. While prior art connecting means and methods have been considered satisfactory, the present invention provides novel and improved structure affording a positive connection of an electrical cable to a pole-mounted insulating device by an operation which may be performed in seconds with complete safety to the technician.

SUMMARY OF THE INVENTION

The disclosed embodiment of the device of the invention consists basically of three elements, namely, a main body, a piston and a threaded insert. The body has an external configuration resembling a conventional insulating support; that is, it includes a plurality of annular skirts or flanges spaced from one another about their peripheries by an air gap which enhances the insulating properties of the device. In addition to the conventional structure, the body includes an integral hook at what is termed its upper end, and a through, axial bore having an upper portion with a smooth, cylindrical wall of first diameter and an internally threaded lower portion of second diameter, larger than the first diameter.

The piston fits slidingly in the upper part of the body bore, and the insert is threadedly engaged in the lower portion. The insert also includes an internally threaded cavity for mounting the device on the threaded shaft on the support pole. A conduit through the insert communicates with the lower side of the piston. A one-way valve permits a fluid or gel to be injected from a conventional, hand-held tool, through the conduit, to move the piston upwardly. A concave portion on the upper end of the piston mates with the downwardly directed, curved surface of the hook on the body portion to define a fully enclosed passageway through which the conductor extends.

The foregoing and other features of construction and operation of the insulating support clamp of the invention will be more readily understood and fully appreciated from the following detailed disclosure, taken in conjunction with the accompanying drawings.

DETAILED DESCRIPTION

Figure 1:
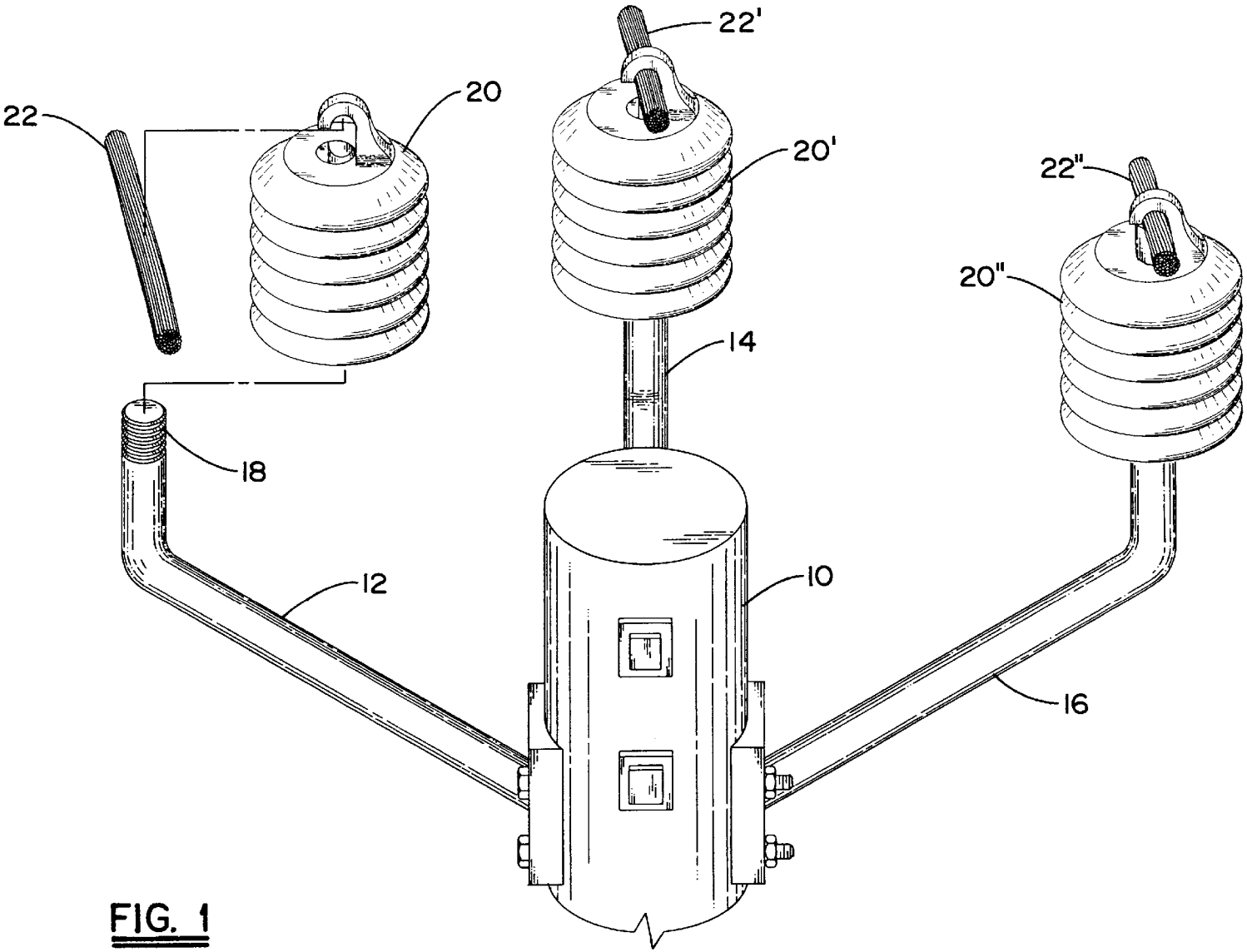
FIG. 1 is a perspective view of a plurality of insulating supports embodying the invention shown in various stages of installation on the arms of a support pole and on electrical conductors.

Referring now to the drawings, in FIG. 1 is shown the upper portion of a conventional electric utility pole 10 of typical construction having three arms 12, 14 and 16 extending from the upper end thereof. Each of the arms carries, at the distal end thereof, a threaded shaft, one of which, denoted by reference numeral 18, is seen in FIG. 1 on the end of arm 12. An insulating support 20, 20', 20" is mounted on the threaded shaft of respective arms 12, 14 and 16 to engage and support the respective conductors 22, 22', 22". Support 20 is shown in spaced relation to shaft 18, preparatory to being threadedly engaged therewith. Support 20' is shown mounted on the shaft of arm 14, prior to permanent engagement with conductor 22', and support 20" is shown in fully installed condition, mounted on arm 16 and engaged with conductor 22".

Figure 2:
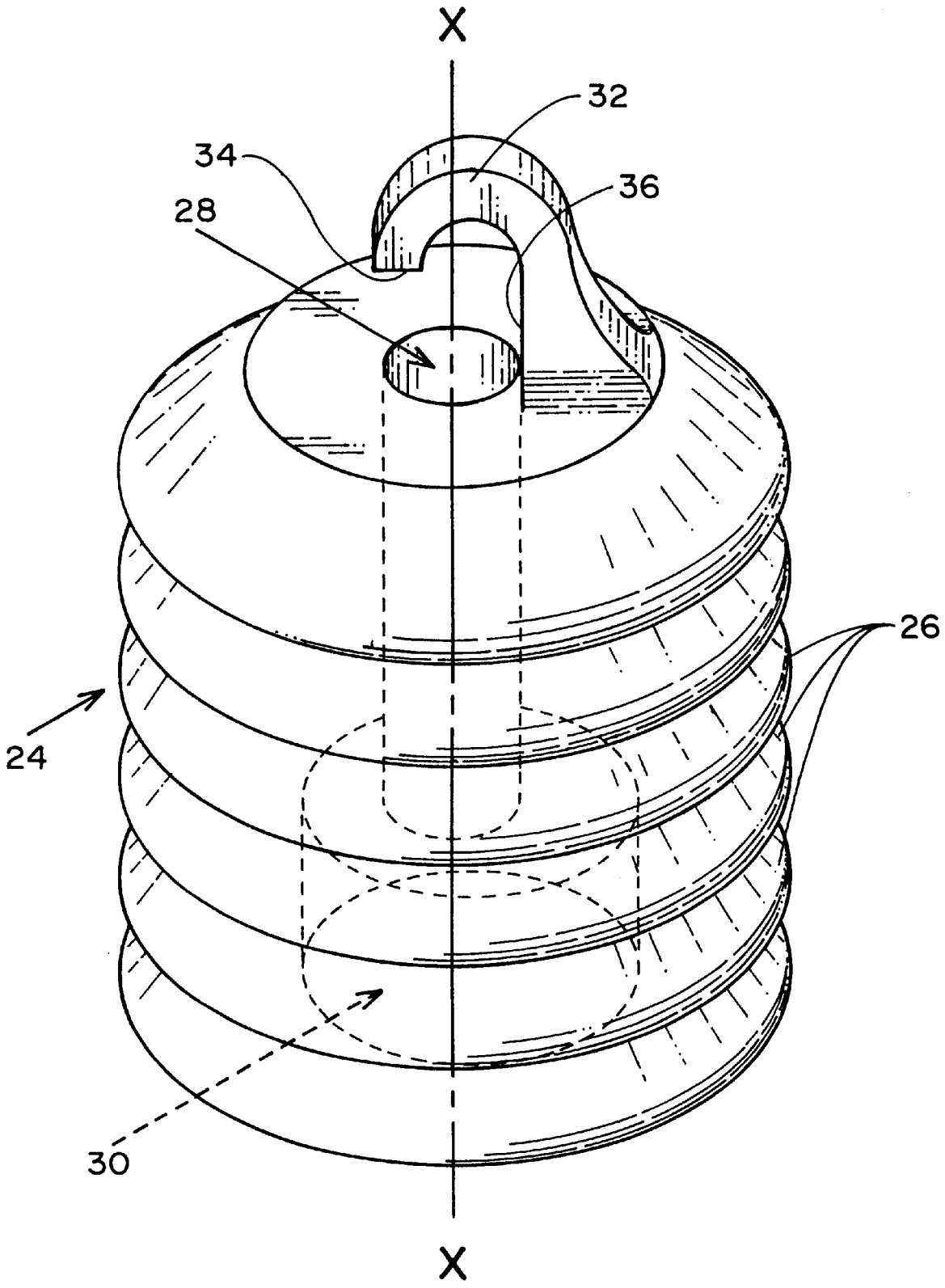
FIGS. 2, 3 and 4 are perspective views of the body, piston and threaded insert of the device, respectively.
Figure 3:
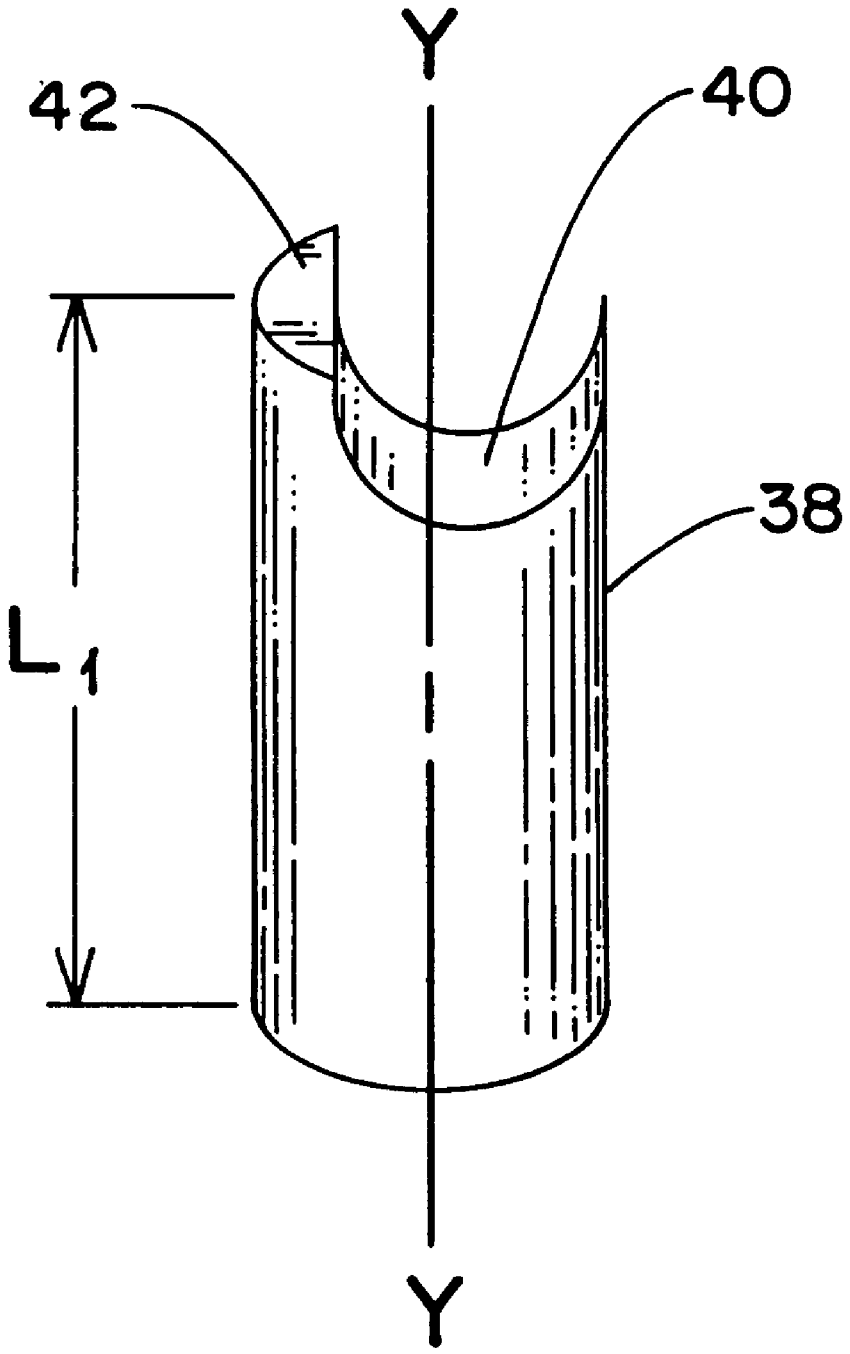
Figure 4:
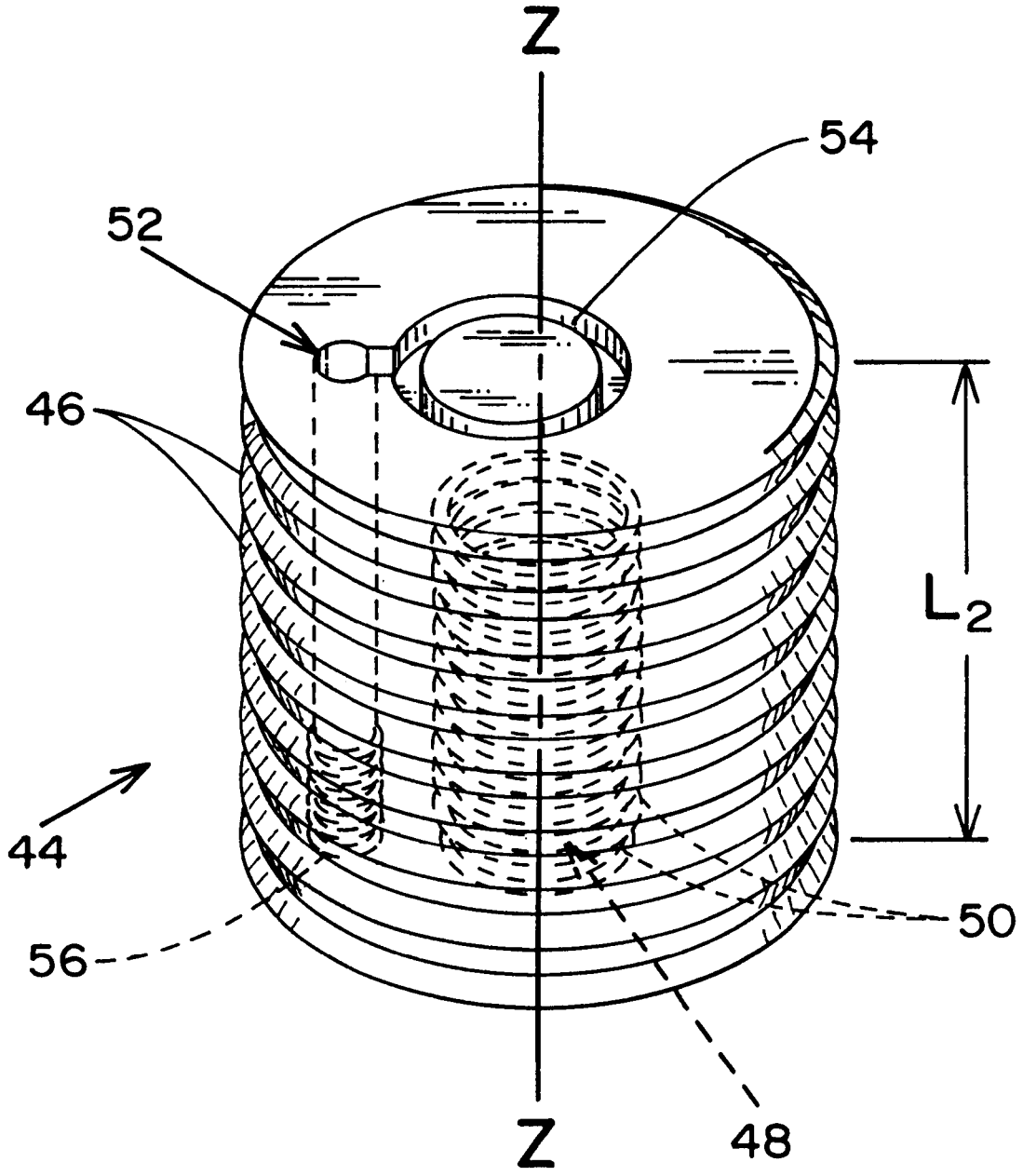

The three structural elements which form the insulating support of the invention are shown individually in FIGS. 2, 3 and 4. Body member 24, as seen in FIG. 2, has a plurality of axially spaced, circular flanges 26 symmetrically arranged about central axis X—X. This feature is typical of such devices with the air space between the flanges enhancing the insulating qualities of the device. A through, axial bore in body 24 has a cylindrical upper portion 28 and an internally threaded lower portion 30. Hook 32 is integrally formed at the upper end of body 24, extending over the axial bore. The flat, downwardly directed, terminal end 34 of hook 32 is aligned with one side of bore portion 28, and concave portion 36 is upwardly adjacent, in the extended plane of the other side.

Piston 38, having central axis Y—Y, is individually shown in FIG. 3. The diameter of piston 38 is essentially the same as that of upper bore portion 28, and the axial length $L_1$ of piston 38 is approximately equal to that of upper bore portion 28. Concave surface 40 is formed in the upper end of piston 38, adjacent flat end portion 42. As explained later, piston 38 is slidingly movable in bore portion 28 of body 24, into and out of cooperative engagement with hook 32.

Threaded insert 44, shown individually in FIG. 4, is generally cylindrical, having central axis Z—Z and an axial length $L_2$ substantially equal to the axial length of lower bore portion 30. External threads 46 extend between opposite ends and blind bore 48, having threads 50, extends into the lower end. Passageway 52 extends axially through insert 44 and communicates at its upper end with circular groove 54 in the upper surface of the insert. One-way valve 56 is installed in the lower end of passageway 52.

Figure 5:
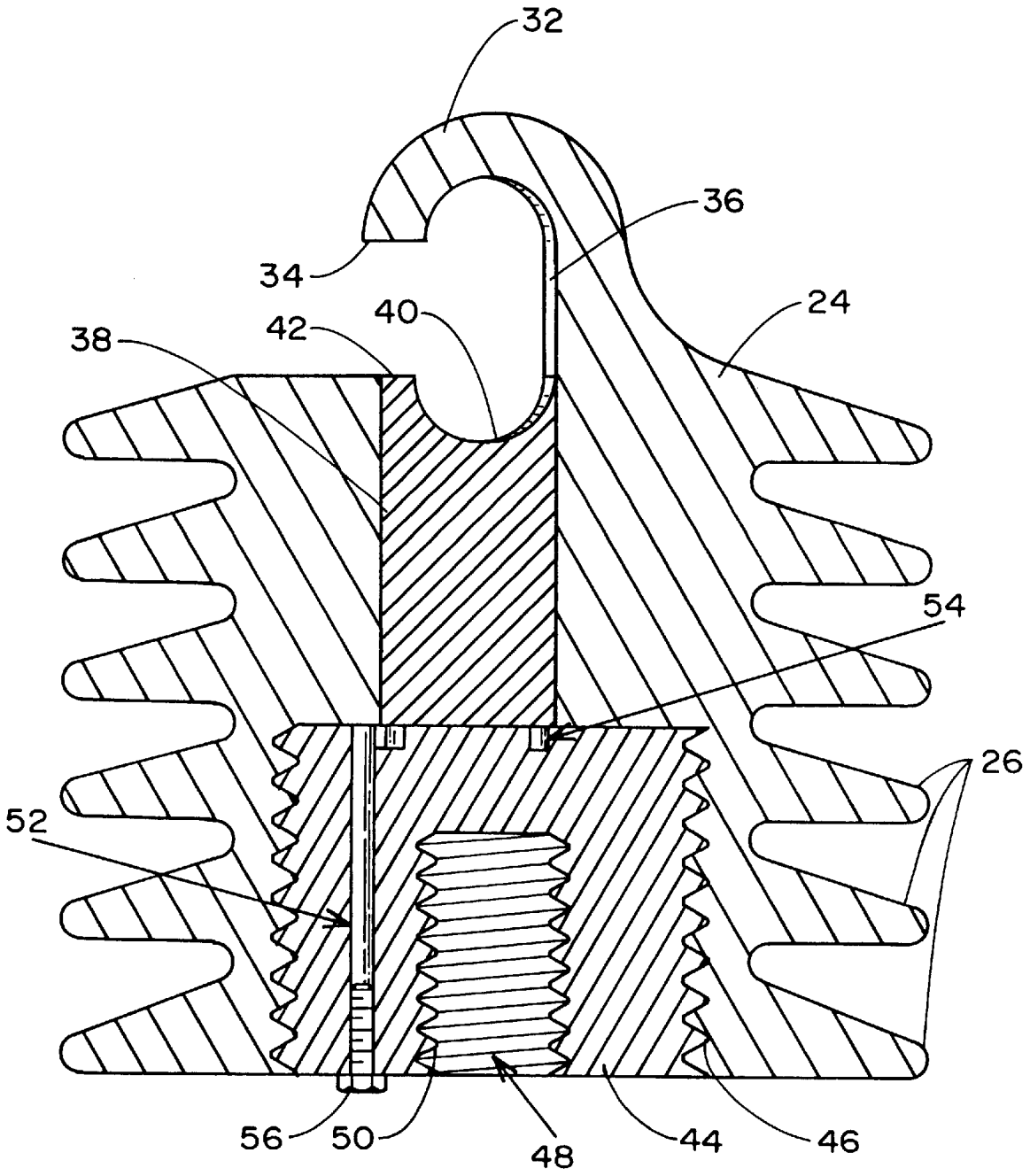
FIGS. 5 and 6 are elevational views, in full section, showing the assembled elements of the device with the piston in lower and upper terminal positions, respectively.

The elements of insulating support 20 are shown in assembled condition in the cross-sectional view of FIG. 5. Piston 38 is slidingly inserted from below into upper bore portion 28 of body 24, and insert 44 is threaded into lower bore portion 30. When so assembled, central axes X—X, Y—Y and Z—Z of the body, piston and insert are coaxial. Internal threads 48 are sized for engagement with threaded shaft 18 on the arm of a utility pole, or other location. The lower end of one-way valve 56, which may be in the nature of a conventional grease fitting, is unobstructed and thus accessible for engagement by a hand-held grease gun or other conventional tool containing or connected to a source of flowable material.

Figure 6:
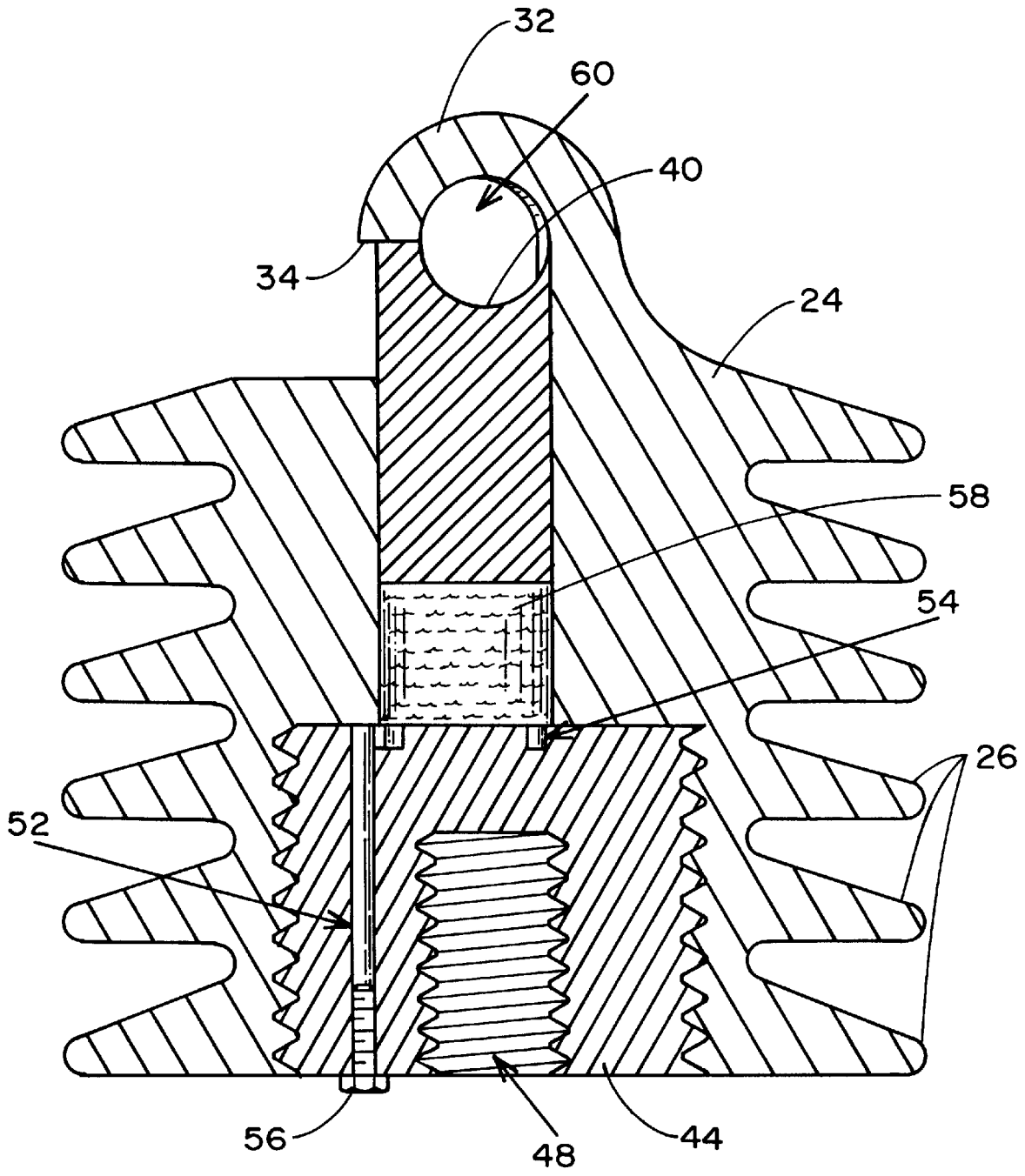

After support 20 is mounted on the threaded shaft, conductor 22 is placed in the space between concave surface 40 of piston 38 and the downwardly directed, curved portion of hook 32. A technician then places the injection tool in engagement with one-way valve 56 and causes the fluid to pass through valve 56 and passageway 52, into groove 54 to exert a hydraulic lifting force on piston 38. Fluid 58 is seen in FIG. 6 filling the lower part of bore portion 28 to an extent causing movement of piston 38 to engage upper surface portion 42 of the piston with surface 34 of hook 32. Thus, piston 38 and hook 32 cooperate to define circular opening 60 through which the conductor extends.

All of the elements of the support device, i.e., body 24, piston 38 and insert 44, are constructed of suitable plastic or other dielectric material. Also, it is preferred that fluid 58 be a silicone gel, or the like, rather than a conventional hydraulic oil, in order to enhance the insulating qualities of the device. The installation is essentially permanent, the conductor is fully surrounded and thus not subject to being dislodged from the support, and the procedure is simple, fast and safe. While the disclosed structure forms the presently preferred embodiment of the device, it is apparent that many changes may be made within the scope of the invention. For example, insert 44 could be integral with body 24, with appropriate porting of the fluid into bore portion 28.

What is claimed is:

1. An insulating support device for mounting on a utility pole, or equivalent structure, to engage and support an electrical transmission or distribution line in an elevated position, said device comprising:

a) a first member having a first surface portion;

b) a second member having a second surface portion;

c) means for mounting said first and second members for movement relative to one another from an initial position, wherein said line may be moved laterally to a position between said first and second surface portions, to a terminal position, wherein said first and second surface portions cooperatively surround said line; and d) means for actuation by a low-pressure fluid to effect said relative movement.

2. The device of claim 1 wherein said first and second surface portions are each curved about parallel axes.

3. The device of claim 2 wherein said second member is movable in a linear direction, perpendicular to said parallel axes.

4. The device of claim 1 wherein said first member comprises a body having a cylindrical bore.

5. The device of claim 4 wherein said second member comprises a piston movable in said cylindrical bore in response to said fluid actuation.

6. The device of claim 5 wherein said piston has a lower surface positioned within said bore to be acted upon by said low-pressure fluid, and an upper surface at least a portion of which forms said second surface portion.

7. The device of claim 6 wherein said body includes a hook portion at least a portion of which forms said first surface portion.

8. The device of claim 1 wherein said first and second surface portions cooperatively define a fully enclosed, substantially circular opening sized to surround said line when said first and second members are in said terminal position.

9. The device of claim 8 wherein said first member has a central axis and a plurality of spaced flanges symmetrically arranged about said central axis.

10. The device of claim 9 wherein said member has a through, axial bore, and said second member comprises a piston slidingly movable within said bore between said initial and terminal positions.

11. The device of claim 10 wherein said piston includes an end surface having a concave portion forming at least part of said second surface portion.

12. An insulating support device for mounting on a utility pole, or equivalent structure, to engage and hold an electrical conductor in a fixed position, said device comprising:

a) a body member having upper and lower ends, a longitudinal axis extending through said ends, a cylindrical bore parallel to said axis and open at least at said upper end, a plurality of axially spaced flanges, and a first surface portion extending over the upper end of said bore;

b) a piston having first and second, opposite ends, said first end having a second surface portion, said piston being mounted in said cylindrical bored for sliding movement from an initial position, wherein said conductor may be moved laterally to a position between said first and second surface portions, and a terminal position, wherein said first and second surface portions cooperatively define a peripherally enclosed passageway through which said conductor extends; and c) a non-compressible fluid for injection at low pressure into said cylindrical bore to exert a force on said second end of said piston to effect movement thereof from said initial to said terminal position.

13. The device of claim 12 wherein said fluid is a silicone gel.

14. The device of claim 12 wherein said body member includes a hook portion extending integrally from said upper end, curved about a transverse axis perpendicular to said longitudinal axis, to a terminal end spaced from said body member upper end.

15. The device of claim 14 wherein said second surface portion comprises a concave portion of said first end of said piston.

16. The device of claim 15 wherein said first end of said piston further includes a portion of said first end adjacent said concave portion which contacts said terminal end of said hook portion when said piston is in said terminal position.

17. The device of claim 12 and further including an internally threaded bore extending into said lower end of said body member.

18. The device of claim 17 wherein said cylindrical bore communicates with said threaded bore to form a through bore in said body member.

19. The device of claim 18 and further including an externally threaded insert positioned in and threadedly engaged with said internally threaded bore, said insert having an internally threaded, blind bore for engagement with an externally threaded shaft for mounting said device, in said fixed position.

20. The device of claim 19 and further including a passageway extending through said insert for injection of said fluid into said cylindrical bore.

* * * * *